US005630550A

United States Patent [19]

Kurishige et al.

[11] Patent Number: 5,630,550

[45] Date of Patent: May 20, 1997

[54] FUEL INJECTION SYSTEM

[75] Inventors: Masahiko Kurishige; Koji Hasunaka; Masaaki Kawamoto; Michio Fujiwara; Shinji Nakadeguchi, all of Amagasaki, Japan

[73] Assignee: Mitsubishi Denki Kabushiki Kaisha, Tokyo, Japan

[21] Appl. No.: 427,830

[22] Filed: Apr. 26, 1995

[30] Foreign Application Priority Data

Aug. 25, 1994 [JP] Japan ..... 6-201085

[51] Int. Cl.[6] ..... F02M 51/06

[52] U.S. Cl. ..... 239/533.8; 239/584

[58] Field of Search ..... 239/533.2, 533.4, 239/533.8, 533.9, 584

[56] References Cited

U.S. PATENT DOCUMENTS

| | | | |
|---|---|---|---|
| 4,687,136 | 8/1987 | Ozu | 239/533.8 |
| 4,909,440 | 3/1990 | Mitsuyasu | 239/533.8 |
| 4,986,472 | 1/1991 | Warlick | 239/533.8 |
| 5,271,565 | 12/1993 | Cerny | 239/533.8 |
| 5,335,861 | 8/1994 | Matusaki | 239/533.8 |
| 5,452,858 | 9/1995 | Tsuzuki | 239/533.8 |

FOREIGN PATENT DOCUMENTS 187363 7/1989 Japan .

*Primary Examiner*—Robert J. Oberleitner
*Assistant Examiner*—C. T. Bartz
*Attorney, Agent, or Firm*—Sughrue, Mion, Zinn, Macpeak & Seas

[57] ABSTRACT

A fuel injection system permits the use of hydraulic control oil as a pressure transmitting medium and enables reliable valve opening and closing performance regardless of operating environment. The housing of the fuel injection system is constituted by a valve main body and a cylinder main body, the flowing channel of fuel being airtightly separated from a pressure control chamber. The cylinder main body incorporates a piezoelectric element, which changes the fluid pressure of the pressure transmitting medium in the pressure control chamber, a piston, and a cylinder having an inflow/outflow hole. A needle valve is installed, penetrating the cylinder main body so that the distal end thereof is located in a needle guide cavity of the valve main body and the other end thereof is located in the cylinder.

7 Claims, 10 Drawing Sheets

FUEL INJECTION SYSTEM

BACKGROUND OF THE INVENTION

1. Field of the Invention

The present invention relates to a fuel injection system of, for example, an internal-combustion engine.

2. Description of the Related Art

FIG. 16 is the longitudinal sectional view of a conventional fuel injection system disclosed in Japanese Patent Laid-Open No. 1-187363.

In the figure, a injection aperture 1 is provided at the distal end of a valve main body 2, the injection aperture 1 being communicated with a needle guide cavity 3 formed at the axial center of the valve main body 2. A needle valve is inserted in the needle guide cavity 3 in such a manner that it is allowed to move in the direction of the axis of the valve main body 2. The needle valve 4 is pressed toward the injection aperture 1 by the urging force of a compression spring 5 when no fuel G is present in the needle guide cavity 3, so that the distal end thereof engages with the injection aperture 1 to close the injection aperture 1, Thus keeping the valve in a closed state. Further, an opening pressure receiving section 6 which receives valve opening pressure of fuel G in the needle guide cavity 3 is provided on the side of the injection aperture 1 of the needle valve 4; a closing pressure receiving section 7 which receives valve closing pressure of fuel G is provided in a position opposite from the injection aperture 1 of the needle valve 4. Thus, with fuel G present in the needle guide cavity 3, a difference in pressure of fuel G applied to the opening pressure receiving section 6 and the closing pressure receiving section 7 causes the needle valve 4 to move in the needle guide cavity 3 toward the injection aperture 1 or away from the injection aperture 1, so that the distal end of the needle valve 4 closes or opens the injection aperture 1, thereby closing or opening the valve. A clearance 11 provided between the opening pressure receiving section 6 and the closing pressure receiving section 7 and between the needle guide cavity 3 and the needle valve 4 is formed to be narrow so as to allow only minimal fuel G to flow through.

A pressure control chamber 10 defined by seals 15, the valve main body 2, and a piston 9 is communicated with the needle guide cavity 3 through an aperture 2*a*. A piezoelectric element 8, which is expanded and contracted by a charging/discharging drive circuit (not shown), is provided at the rear of the piston 9. A disc spring 12 is provided so as to urge the piston 9 in a direction for contracting the piezoelectric element 8. A high-pressure fuel chamber 16, which is defined by seals 13 and 14, is provided at the rear of the piston 9. Fuel G supplied from a high-pressure fuel source (not shown) is led into the needle guide cavity 3 and the high-pressure fuel chamber 16.

The operation of the conventional fuel injection system will now be described.

First, fuel G is led into the needle guide cavity 3 and the high-pressure fuel chamber 16. When the charges accumulated in the piezoelectric element 8 are discharged by a driving circuit, the piezoelectric element 8 contracts. This causes the piston 9 to be pushed up by the urging force of the disc spring 12, leading to an increase in the capacity of the pressure control chamber 10. As a result, the pressure of fuel G in the pressure control chamber 10 decreases; the decreased pressure of fuel G is applied to the closing pressure receiving section 7 of the needle valve 4 through the aperture 2*a*. On the other hand, the opening pressure receiving section 6 of the needle valve 4 is subjected to the pressure of fuel G which is supplied from the high-pressure fuel source and which is maintained at a high level. Hence, the pressure applied to the opening pressure receiving section 6 grows higher than that applied to the closing pressure receiving section 7, causing the needle valve 4 to overcome the urging force of the compression spring 5 and move up. The injection aperture 1 is then opened to communicate with the needle guide cavity 3, thereby injecting fuel G through the injection aperture 1.

While the valve is open, fuel G gradually flows from the opening pressure receiving section 6 side into the pressure control chamber 10 through the narrow clearance 11 between the needle valve 4 and the needle guide cavity 3, causing the pressure in the pressure control chamber 10 and the pressure applied to the closing pressure receiving section 7 to approach the level of the pressure applied to the opening pressure receiving section 6. At this time, the urging force of the disc spring 12 and the compression spring 5 and also the passage area of the clearance 11 between the needle valve 4 and the needle guide cavity 3 are controlled so that the valve stays open during the injection of fuel G.

Then, when the piezoelectric element 8 is charged by the driving circuit, the piezoelectric element 8 expands, causing the piston 9 to overcome the urging force of the disc spring 12 and accordingly move down, leading to a decreased capacity of the pressure control chamber 10. As a result, the pressure of fuel G in the pressure control chamber 10 goes up; the increased pressure of fuel G and the urging force of the compression spring 5 are applied to the closing pressure receiving section 7 of the needle valve 4. On the other hand, the opening pressure receiving section 6 of the needle valve 4 is subjected to the pressure of fuel G which is supplied from the high-pressure fuel source and which is maintained at a constant level. Hence, the pressure applied to the opening pressure receiving section 6 becomes lower than that applied to the closing pressure receiving section 7, causing the needle valve 4 to come down. The injection aperture 1 is closed and the communication between the injection aperture 1 and the needle guide cavity 3 is cut off, thereby stopping the injection of fuel G through the injection aperture 1.

During the operation described above, the pressure of fuel G, which is supplied from the high-pressure fuel source and which is applied to the piston 9 from the pressure control chamber 10, is almost offset by the pressure of fuel G which is supplied from the high-pressure fuel source and which is applied to the piston 9 from the high-pressure fuel chamber 16.

In most internal-combustion engines, the temperature changes during operation. For example, the ambient temperature of an automotive internal- combustion engine may be −30° C. or below at the time of starting in a cold district while on the other hand it may rise as high as 50° C. to 200° C. during continuous operation. Fuel G is not an oil produced for hydraulic control; the component proportion of fuel G may vary each time the fuel is supplied. Hence, no stable pressure transferring characteristic is ensured over a wide range of temperature. Taking, for example, gasoline which is extensively used as the fuel for an internal-combustion engine, there is a danger of partially evaporating at a section near the needle valve 4, where the flow velocity increases, in a fuel injection system especially at high temperature because of the evaporation-prone characteristic thereof.

As stated above, since the conventional fuel injection system has the pressure control chamber 10 communicated with the needle guide cavity 3 on the injection aperture 1 side, fuel G is employed as a pressure transmitting medium which is charged in the pressure control chamber 10 to transfer the driving force of the piezoelectric element 8 to the needle valve 4. As a result, a problem was presented in that the pressure transmitting characteristic changes and the valve opening/closing duration heavily depends on temperature due to the temperature characteristic of fuel G stated above, preventing accurate fuel injection control.

There was another problem; bubbles generated in fuel G move close to the opening pressure receiving section 6 and temporarily decrease the pressure around the opening pressure receiving section 6, preventing the opening of the valve. This results in poor fuel metering accuracy and in high toxic component content of the exhaust gas of an internal-combustion engine.

There was a conceivable method wherein the needle valve is directly driven without going through a liquid such as fuel G. This method, however, had a shortcoming in that the piezoelectric element is directly subjected to the force applied to the needle valve, leading to lower durability thereof.

SUMMARY OF THE INVENTION

This invention has been made with a view toward solving the above problems. It is an object of the present invention to provide a fuel injection system which permits the use of hydraulic control oil as a pressure transmitting medium for transmitting the driving force of a piezoelectric element to a needle valve, minimizes the influences exerted by temperature changes in the operating environment of an internal-combustion engine, and prevents bubbles generated in fuel from affecting fuel injection, thus enabling accurate fuel injection control.

To this end, according to one aspect of the present invention, there is provided a fuel injection system equipped with a valve main body, which has a needle guide cavity with the distal end thereof formed as a injection aperture, fuel passing through the needle guide cavity to be injected through the injection aperture; a pressure control chamber filled with a pressure transmitting medium; a piston for changing the fluid pressure of the pressure transmitting medium in the pressure control chamber; a needle valve having one end thereof located in the needle guide cavity and the other end thereof located in the pressure control chamber, the needle valve being installed in such a manner that it is allowed to move to open or close the injection aperture; a pressure receiving section which is provided on a portion of the needle valve located in the pressure control chamber and which is subjected to the fluid pressure; a pre-loading means for pre-loading the needle valve in a direction for closing the injection aperture; and a piezoelectric element which is changed the fluid pressure of the pressure transmitting medium by driving the piston, is applied the changed fluid pressure to the pressure receiving section, and is moved the needle valve in a direction for opening or closing the injection aperture so as to start or stop the injection of the fuel through the injection aperture; and wherein a flowing channel for the fuel is airtightly independent from the pressure control chamber.

DETAILED DESCRIPTION OF THE PREFERRED EMBODIMENTS

The embodiments of the present invention will now be described in conjunction with the accompanying drawings.

[First Embodiment]

Figure 1:
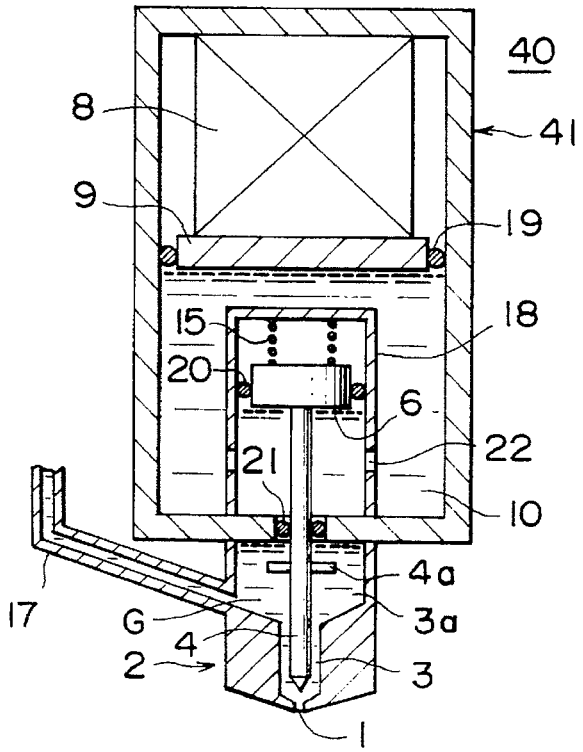
FIG. 1 is a longitudinal sectional view illustrative of a fuel injection system according to a first embodiment of the present invention.
Figure 16:
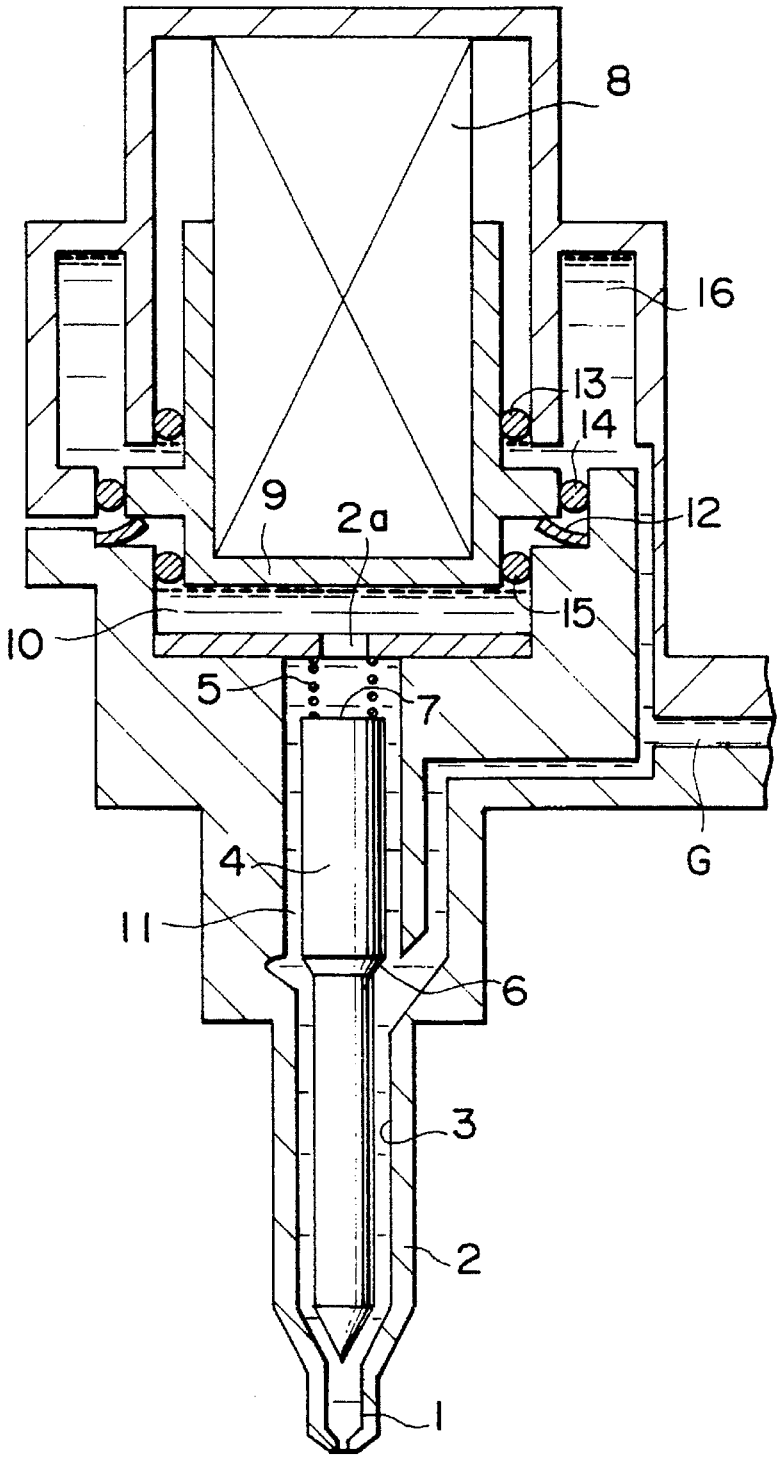
FIG. 16 PRIOR ART
FIG. 16 is a longitudinal sectional view illustrative of a conventional fuel injection system.

FIG. 1 is the longitudinal sectional view illustrative of a fuel injection system according to the first embodiment of the present invention. In the figure, the identical or corresponding parts to those of the conventional fuel injection system shown in FIG. 16 are given the same reference numerals, and the explanation thereof will be omitted.

A housing 40 of the fuel injection system shown in the FIG. 1 is constituted by a valve main body 2 and a cylinder main body 41, the valve main body 2 having a needle guide cavity 3 formed at the axial center thereof. The needle guide cavity 3 has an injection aperture 1 formed at the distal end thereof; the rear end is formed to have a large diameter to form a fuel chamber 3*a*. Fuel G is led from a high-pressure fuel source (not shown) into the fuel chamber 3*a* via a fuel passage 17.

In the cylinder main body 41, a piston 9 is disposed in such a manner that it is allowed to slide up and down in the drawing, a pressure control chamber 10 being defined by the piston 9. The pressure control chamber 10 is filled with a pressure transmitting medium. A piezoelectric element 8 for driving the piston 9 is disposed in the cylinder main body 41. A seal 19 on the piezoelectric side is provided between the outer periphery of the piston 9 and the inner wall surface of the cylinder main body 41 so as to prevent the pressure transmitting medium from flowing into the piezoelectric element 8 side from the pressure control chamber 10.

Provided inside the pressure control chamber 10 is a cylinder 18 which serves as a housing chamber. A side wall of the cylinder 18 has an inflow/outflow hole 22, the pressure transmitting medium moving into and out of the cylinder 18 through the inflow/outflow hole 22.

The needle valve 4 extends beyond the bottom of the cylinder main body 41; it is installed so that the distal end thereof is allowed to move in the direction for opening or closing the injection aperture 1. At this time, one end of the needle valve 4 is located in the needle guide cavity 3 and the other end is located in the cylinder 18. Provided on the other end of the needle valve 4 is an opening pressure receiving section 6 which serves as the pressure receiving section. A compression spring 5, which functions as the pre-loading means, is provided between the cylinder 18 and the other end surface of the needle valve 4 in a compressed state, urging the needle valve 4 in the direction for closing the injection aperture 1. Further, a stopper 4*a* is provided on the portion of the needle valve 4 located in a fuel chamber 3*a*, so that, when the needle valve 4 moves in the direction for opening the injection aperture 1, the stopper 4*a* comes in contact with the cylinder main body 41 to regulate the stroke of the needle valve 4.

A pressure receiving seal 20 is provided between the outer periphery of the opening pressure receiving section 6 of the needle valve 4 and the inner wall surface of the cylinder 18 so as to prevent the pressure transmitting medium from flowing into the compression spring 5 side, thereby maintaining the pressure difference between the areas above and below the opening pressure receiving section 6. A fuel chamber seal 21 is provided at the portion where the needle valve 4 comes through the cylinder main body 41 in order to airtightly separate the pressure control chamber 10 from the flowing channel of fuel G.

The operation of the first embodiment will now be discussed.

When a driving circuit applies voltage to the piezoelectric element 8 until it is charged, the piezoelectric element 8 expands. The expansion of the piezoelectric element 8 causes the piston 9 to move down, decreasing the capacity in the pressure control chamber 10 with a resultant increase in the fluid pressure of the pressure transmitting medium. Then, the pressure transmitting medium in the pressure control chamber 10 flows into the cylinder 18 through the inflow/outflow hole 22, thereby increasing the fluid pressure applied to the opening pressure receiving section 6. The moment the fluid pressure applied to the opening pressure receiving section 6 surpasses the urging force of the compression spring 5, the needle valve 4 moves in a direction for opening the injection aperture 1, thus opening the injection aperture 1. This allows fuel G, which is supplied from the high-pressure fuel source via a fuel passage 17, to pass through the fuel chamber 3*a* and the needle guide cavity 3 to be injected through the injection aperture 1. The needle valve 4 moves until the stopper 4*a* comes in contact with the cylinder main body 41 to restrict the stroke thereof.

Conversely, when the voltage applied to the piezoelectric element 8 is decreased until it is discharged, the piezoelectric element 8 contracts. The contraction of the piezoelectric element 8 causes the piston 9 to move up, increasing the capacity in the pressure control chamber 10 with a resultant decrease in the fluid pressure of the pressure transmitting medium. Then, the pressure transmitting medium in the cylinder 18 flows out into the pressure control chamber 10 through the inflow/outflow hole 22, thereby decreasing the fluid pressure applied to the opening pressure receiving section 6. The moment the fluid pressure applied to the opening pressure receiving section 6 is surpassed by the urging force of the compression spring 5, the needle valve 4 moves in a direction for closing the injection aperture 1 and the distal end thereof comes in contact with the nozzle, thus closing the injection aperture 1 to stop the injection of fuel G.

According to the first embodiment, the fuel chamber seal 21 provides airtight separation of the pressure control chamber 10 from the flowing channel of fuel G. Hence, the pressure transmitting medium in the pressure control chamber 10 and fuel G are not mixed together, permitting unrestrained selection of pressure transmitting medium. Thus, the use of a liquid, which exhibits a better temperature characteristic than that of fuel G, as the pressure transmitting medium, makes it possible to obtain a pressure transmitting characteristic which is stable over a wide temperature range and also to protect the pressure transmitting characteristic from being affected by partially evaporated fuel G in the fuel injection system, thereby achieving stable valve opening and closing performance regardless of operating environment.

The pressure transmitting medium is required to have a low saturated vapor pressure even under high temperature to control the generation of bubbles. Further, the medium provides lubrication for the needle valve 4 to move as well as it transfers pressure; therefore, the medium is also required to exhibit stable lubricating property for the needle valve 4 to move smoothly, i.e., stable viscosity coefficient against temperature changes. For these reasons, the liquid used for the pressure transmitting medium should be a lubricant such as engine oil and gear oil or hydraulic oil for a hydraulic circuit which do not reach the saturated vapor pressure at 200° C. and atmospheric pressure to survive the operating temperature of the internal-combustion engine and which have good lubricating property.

By employing the engine oil, gear oil, or the hydraulic oil for a hydraulic circuit, the occurrence of bubbles in the pressure transmitting medium filled in the pressure control chamber 10 can be prevented and therefore the deterioration in the pressure transmitting characteristic can be prevented even when, for example, the ambient temperature reaches 150° C. to 200° C. from continuous operation in an automotive internal-combustion engine. Moreover, an increase in the viscosity coefficient of the pressure transmitting medium can be controlled and the lubricating property can be maintained to ensure smooth operation of the piston 9 and the needle valve 4 even if the ambient temperature goes down to −30° C. or less at the time of startup in a cold region.

[Second Embodiment]

Figure 2:
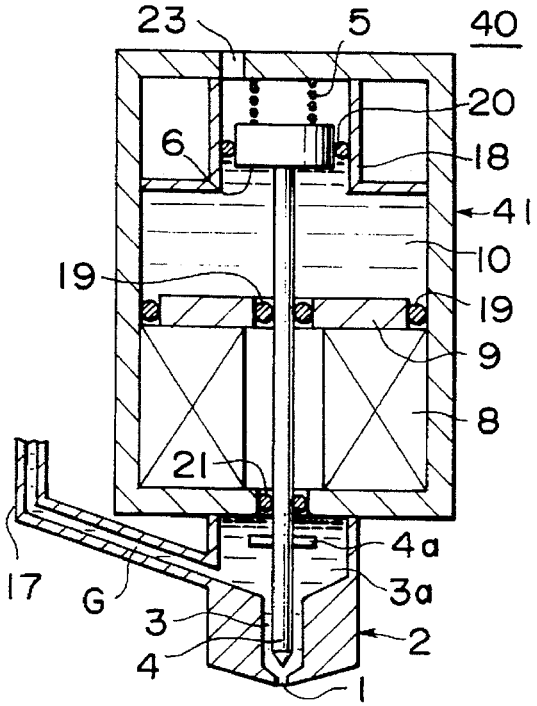
FIG. 2 is a longitudinal sectional view illustrative of a fuel injection system according to a second embodiment of the present invention.

FIG. 2 is the longitudinal sectional view illustrative of the fuel injection system according to the second embodiment of the present invention.

In the figure, the piezoelectric element 8 is configured to be a disc or a column with a throughhole provided at the center thereof. The piezoelectric element 8 is provided on the bottom side of the cylinder main body 41, the needle valve 4 coming through the through-hole of the piezoelectric element 8. Provided on the piezoelectric element 8 in the cylinder main body 41 is the piston 9 which is disposed in such a manner that it is allowed to slide up and down. The piston 9 has a hole at the center thereof, the needle valve 4 coming through the hole. Seals 19 on the piezoelectric side are provided, one each on the outer periphery of the piston 9 and the inner circumference of the hole so as to prevent the pressure transmitting medium from flowing into the piezoelectric element 8 side.

Provided in the upper section inside the cylinder main body 41 is a cylinder 18. The other end of the needle valve 4 is located in the cylinder 18. Further, a compression spring 5 is provided between the cylinder 18 and the other end surface of the needle valve 4 in a compressed state, urging the needle valve 4 in the direction for closing the injection aperture 1. A pressure receiving seal 20 is provided on the outer periphery of the opening pressure receiving section 6 of the needle valve 4 to prevent the pressure transmitting medium from flowing to the rear of the opening pressure receiving section 6 of the needle valve 4. The rear of the opening pressure receiving section 6 where the compression spring 5 of the cylinder 18 is disposed is opened to the air through an opened-to-the-air aperture 23. The pressure control chamber 10 is defined by the piston 9 and the opening pressure receiving section 6 of the needle valve 4.

The rest of the construction of this embodiment is identical to the structure of the first embodiment described previously; the operation is also the same as that of the first embodiment.

According to the second embodiment thus constructed, the same advantages as those of the first embodiment stated above can be obtained. Furthermore, the length of the housing 40 can be reduced since the disc-shaped or column-shaped piezoelectric element 8 with the through-hole at the center thereof is located at the bottom in the cylinder main body 41 with the needle valve 4 coming through the through-hole of the piezoelectric element 8; therefore, the completed fuel injection system can be made smaller. In addition, since the rear of the opening pressure receiving section 6, where the compression spring 5 is disposed, is opened to the air via the opened-to-the-air aperture 23, the pressure applied to the rear surface of the opening pressure receiving section 6 can be maintained at a constant level even if the pressure transmitting medium leaks through the pressure receiving seal 20.

[Third Embodiment]

Figure 3:
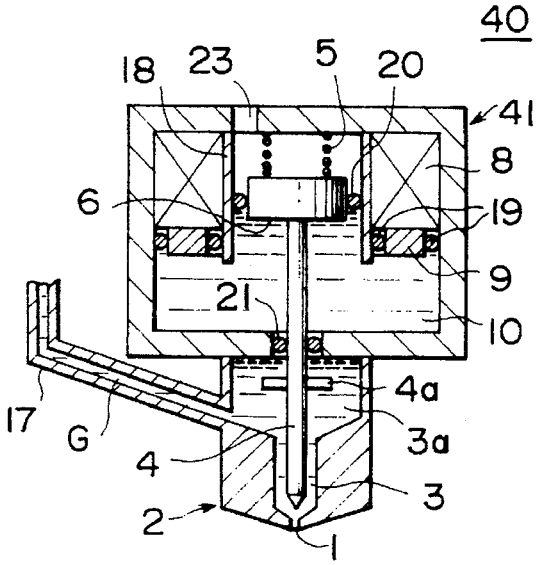
FIG. 3 is a longitudinal sectional view illustrative of a fuel injection system according-to a third embodiment of the present invention.

FIG. 3 is the longitudinal sectional view illustrative of the fuel injection system according to the third embodiment of the present invention.

In the figure, the cylinder 18 is configured by a cylindrical partition installed on the top inner surface of the cylinder main body 41. The other end of the needle valve 4 is located in the cylinder 18. Further, the disc-shaped or column-shaped piezoelectric element 8 with a through-hole in the center thereof is disposed aroung the cylinder 18 at the top inside the cylinder main body 41. The piston 9 with a hole formed at the center thereof is disposed on the bottom of the piezoelectric element 8. Seals 19 on the piezoelectric side are provided, one each on the outer periphery of the piston 9 and the inner circumference of the hole of the piston 9. A pressure receiving seal 20 is provided on the outer periphery of the opening pressure receiving section 6 of the needle valve 4. The rear of the opening pressure receiving section 6, where the compression spring 5 of the cylinder 18 is disposed, is opened to the air through the opened-to-the-air aperture 23. The pressure control chamber 10 is defined by the piston 9 and the opening pressure receiving section 6 of the needle valve 4.

The rest of the construction of this embodiment is identical to the structure of the second embodiment described previously; the operation is also the same as that of the second embodiment.

According to the third embodiment thus constructed, the same advantages as those of the second embodiment stated above can be obtained. Furthermore, the disc-shaped or column-shaped piezoelectric element 8 with the through-hole at the center thereof is located at the top in the cylinder main body 41, the cylinder 18 being housed in the through-hole of the piezoelectric element 8; therefore, the length of the housing 40 can be further reduced, allowing the completed fuel injection system to be made even smaller.

[Fourth Embodiment]

Figure 4:
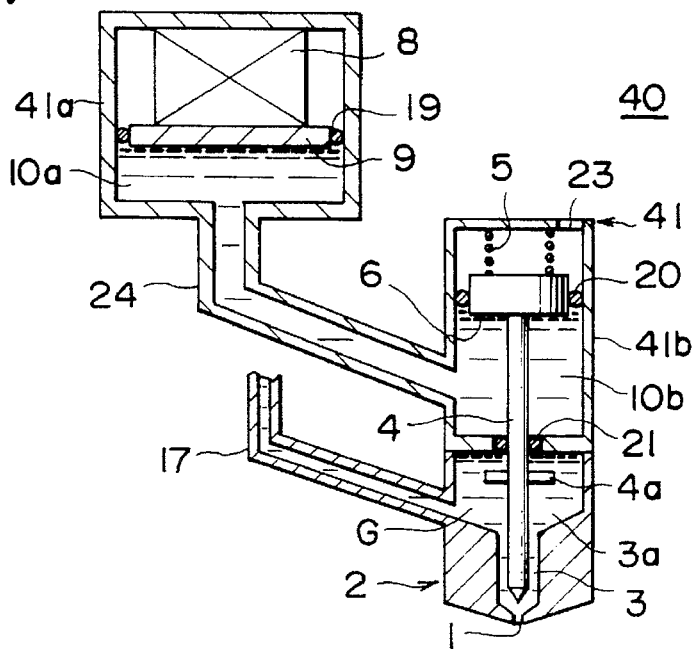
FIG. 4 is a longitudinal sectional view illustrative of a fuel injection system according to a fourth embodiment of the present invention.

FIG. 4 is the longitudinal sectional view of the fuel injection system according to the fourth embodiment of the present invention.

In the figure, the cylinder main body 41 is constituted by a first cylinder main body **41*a* and a second cylinder main body 41*b*. The first cylinder main body 41*a* incorporates the piezoelectric element 8 and the piston 9; the second cylinder main body 41*b* contains the other end of the needle valve 4. Further, a first pressure control chamber 10*a* defined by the piston 9 and a second pressure control chamber 10*b* defined by the opening pressure receiving section 6 of the needle valve 4 are communicated through a pressure transmitting pipe 24. The rear of the opening pressure receiving section 6, where the compression spring 5 of the second cylinder main body 41*b* is disposed, is opened to the air through the opened-to-the-air aperture 23**.

The rest of the construction of this embodiment is identical to the structure of the first embodiment described previously.

In the fourth embodiment, the piston 9 is driven by the piezoelectric element 8 to change the capacity inside the first pressure control chamber **10*a*. A change in the fluid pressure of the pressure transmitting medium in the first pressure control chamber 10*a* is transferred to the second pressure control chamber 10*b* via the pressure transmitting pipe 24 and it is applied to the opening pressure receiving section 6 of the needle valve 4. The change in the fluid pressure applied to the opening pressure receiving section 6 causes the needle valve 4 to move in the direction for closing or opening the injection aperture 1**. The rest of the operation is the same as the operation in the first embodiment described previously.

According to the fourth embodiment thus constructed, the same advantages as those of the first embodiment previously stated are obtained. Furthermore, since the pressure control chamber 10 is divided into the first and second pressure control chambers **10*a* and 10*b***, respectively, the degree of freedom of the layout of the fuel injection system can be increased.

[Fifth Embodiment]

Figure 5:
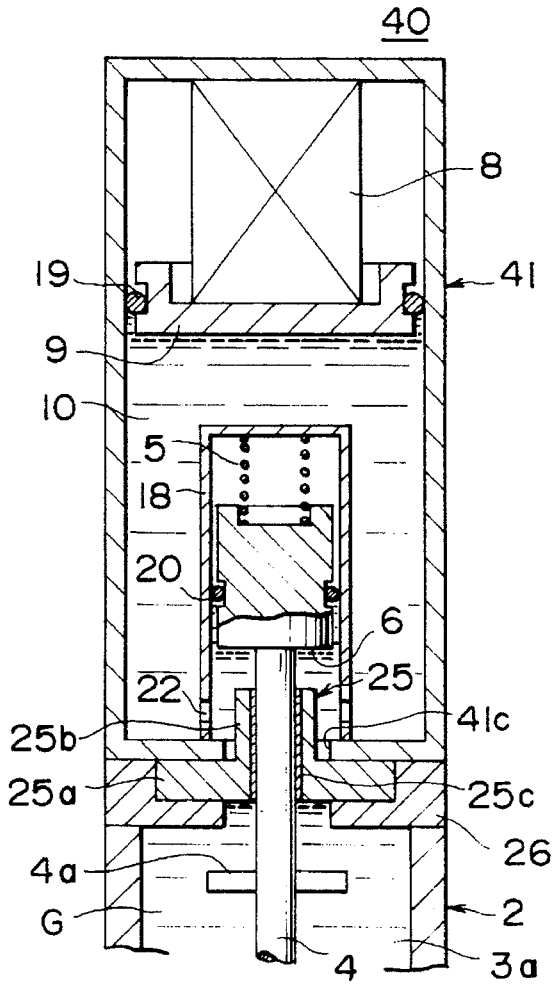
FIG. 5 is a longitudinal sectional view illustrative of a cylinder main body assembly of a fuel injection system according to a fifth embodiment of the present invention.

FIG. 5 is the longitudinal sectional view illustrative of the cylinder main body assembly of a fuel injection system according to the fifth embodiment of the present invention.

In the figure, a rubber body 25 made of, for example, silicone rubber, has a disc-shaped flange **25*a* and a cylindrical fitting section 25*b* which is provided at the center of the flange 25*a*. The rubber body 25 is fixed, with an adhesive agent 25*c*, to the shaft of the needle valve 4 which is fitted in the central hole of the fitting section 25*b*. The rubber body 25 is disposed so that the fitting section 25*b* is fitted in an opening 41*c* provided in the bottom of the cylinder main body 41, a holding frame 26 being applied to the rubber body 25 from the bottom being tightened and fixed to the bottom of the cylinder main body 41. At this time, the flange 25***a* of the rubber body 25 is pressed and compressed by the cylinder main body 41 and the holding frame 26 so as to provide airtight isolation of the pressure control chamber 10 from the flowing channel of fuel G.

The rest of the construction-is the same as the construction of the first embodiment stated above.

In the fifth embodiment, when the piston 9 is driven by the piezoelectric element 8, the fluid pressure of the pressure transmitting medium applied to the opening pressure receiving section 6 of the needle valve 4 changes and the needle valve 4 moves in the direction for closing or opening the injection aperture 1 as in the case of the first embodiment discussed above. In the fifth embodiment, the rubber body 25 is elastically deformed in the direction of the movement of the needle valve 4 by the driving force which moves the needle valve 4 up or down, thereby permitting the opening and closing operation of the needle valve 4. The adhesive agent 25*c* fixes the fitting section 25*b* of the rubber body 25 to the needle valve 4 and the flange 25*a* of the rubber body 25 is pressurized and compressed by the cylinder main body 41 and the holding frame 26; therefore, the pressure transmitting medium does not leak into the fuel chamber 3*a*.

The rest of the operation is the same as the operation of the first embodiment.

According to the fifth embodiment thus constructed, the same advantages as those of the first embodiment discussed above can be obtained. In addition, the pressure transmitting medium does not leak into the fuel chamber 3*a* since the pressure control chamber 10 is securely separated from the fuel chamber 3*a* in an airtight manner. Hence, a constant amount of the pressure transmitting medium in the pressure control chamber 10 is maintained and the pre-loading can be maintained, enabling reliable valving operation.

In the fifth embodiment described above, the flange 25*a* of the rubber body 25 is pressurized and compressed by the cylinder main body 41 and the holding frame 26; alternatively, an adhesive agent may be used to glue the flange 25*a*, the cylinder main body 41, and the holding frame 26 together to fix them. This will provide even more secure airtight isolation of the pressure control chamber 10 from the fuel chamber 3*a*.

[Sixth Embodiment]

Figure 6:
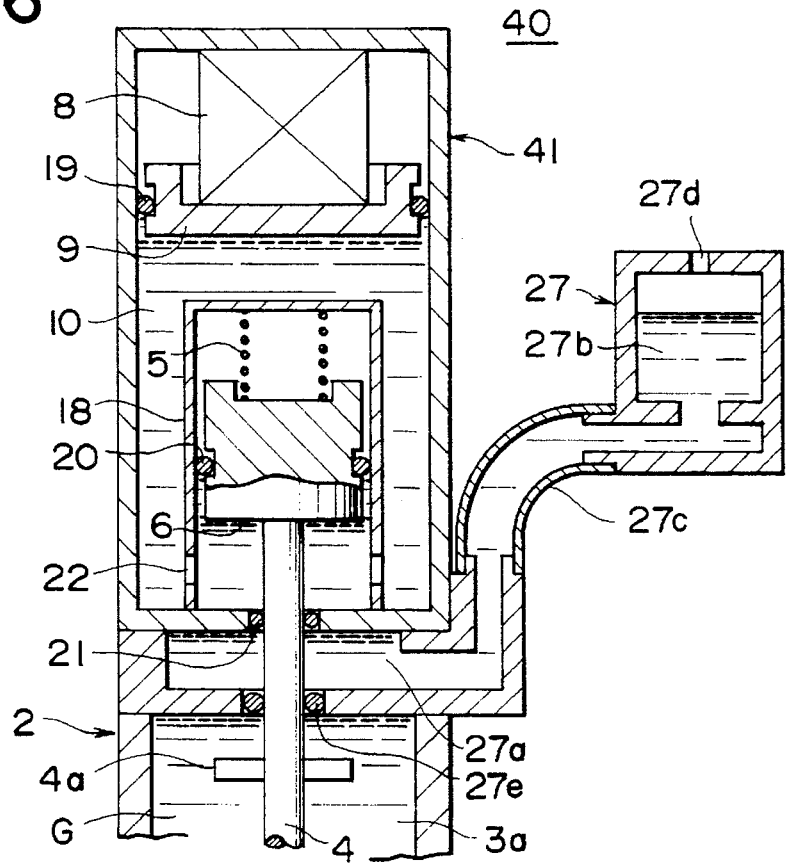
FIG. 6 is a longitudinal sectional view illustrative of a cylinder main body assembly of a fuel injection system according to a sixth embodiment of the present invention.

FIG. 6 is the longitudinal sectional view illustrative of the cylinder main body assembly of a fuel injection system according to the sixth embodiment of the present invention.

In the figure, a liquid amount regulator 27, which controls the amount of the pressure transmitting medium in the pressure control chamber 10, is provided at the bottom of the cylinder main body 41. The liquid amount regulator 27 is constituted by a liquid chamber 27*a* provided at the bottom of the cylinder main body 41, a liquid reservoir 27*b* having an air hole 27*d* for releasing to the air, and a liquid channel 27*c* which communicates the liquid chamber 27*a* and the liquid reservoir 27*b*. The liquid amount regulator 27 is filled with the pressure transmitting medium. Further, a liquid seal 27*e* is provided at a portion of the liquid chamber 27*a* where the needle valve 4 comes through.

The rest of the construction is the same as the construction of the first embodiment described above.

In the sixth embodiment, when the needle valve 4 moves to open the injection aperture 1, the piezoelectric element 8 drives the piston 9 and the capacity of the pressure control chamber 10 decreases, causing the pressure of the pressure transmitting medium to increase. At this time, if the fuel chamber seal 21 is defective, the pressure transmitting medium leaks out through the fuel chamber seal 21. This gives rise to a problem in that the volume of the pressure transmitting medium decreases, causing a change in the pressure transmitting characteristic of the pressure control chamber 10

A fuel injection system is not in operation at all times; the engine is stopped for a considerable period of time in the case of a car, for example. If the amount of the pressure transmitting medium in the pressure control chamber 10 has been decreased, then the fluid pressure in the pressure control chamber 10 goes down and becomes lower than the fluid pressure in the liquid chamber 27*a*. Hence, while the engine is in a stopped state, according to the difference in fluid pressure between the pressure control chamber 10 and the liquid chamber 27*a*, the pressure transmitting medium flows into the pressure control chamber 10 from the liquid chamber 27*a* through the fuel chamber seal 21, thus controlling the pressure transmitting medium in the pressure control chamber 10 to a predetermined amount.

According to the sixth embodiment thus constructed, the same advantages as those of the first embodiment described previously will be obtained. In addition, since the pressure transmitting medium in the pressure control chamber 10 is controlled to a predetermined amount, time-dependent changes of the pressure transmitting characteristic of the pressure control chamber 10 can be prevented, enabling stable valve opening and closing operation.

[Seventh Embodiment]

Figure 7:
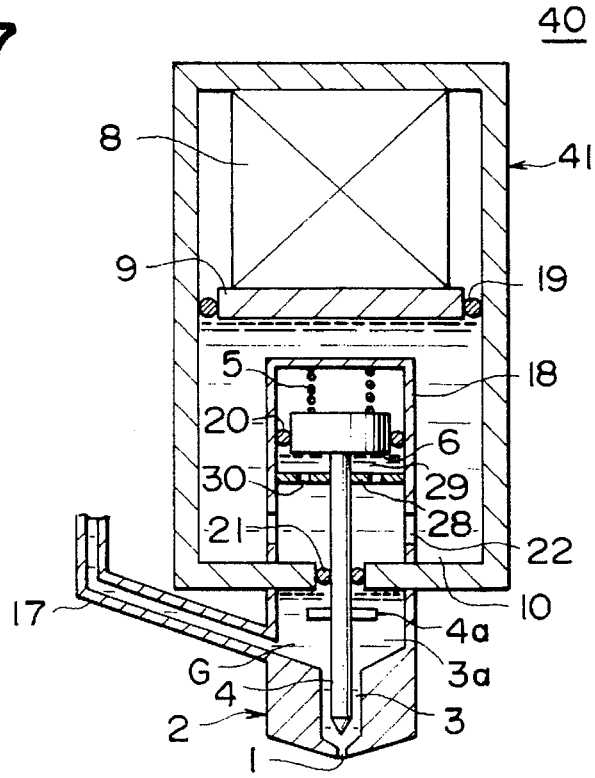
FIG. 7 is a longitudinal sectional view illustrative of a fuel injection system according to a seventh embodiment of the present invention.

FIG. 7 is the longitudinal sectional view illustrative of a fuel injection system according to the seventh embodiment of the present invention.

In the figure, provided in the cylinder 18 is a partitioning plate 28 which provides a partition between the area on the opening pressure receiving section 6 side and the area on the inflow/outflow hole 22 side with respect to the needle valve 4. A cylinder sub-chamber 29 defined by the opening pressure receiving section 6 and the partitioning plate 28 is provided. A small orifice 30 is formed in the partitioning plate 28, the cross-sectional area of the small orifice 30 being set so that the cross-sectional area of the small orifice 30<< the cross-sectional area of the inflow/outflow hole 22. As the pressure transmitting medium, engine oil or other liquid which has higher viscosity than fuel G and which exhibits a minimum of temperature-dependent change in the characteristic.

The rest of the construction of this embodiment is the same as the construction of the first embodiment described above.

In the seventh embodiment, when the piston 9 is driven by the piezoelectric element 8, the capacity of the pressure control chamber 10 changes and the fluid pressure of the pressure transmitting medium changes accordingly as in the case of the first embodiment discussed above. Further, the fluid pressure of the pressure transmitting medium applied to the opening pressure receiving section 6 of the needle valve 4 changes to open or close the needle valve 4.

In the operation stated above, the pressure transmitting medium passes through the small orifice 30 and flows into the cylinder sub-chamber 29 or flows out of the cylinder sub-chamber 29. At this time, since the viscosity of the pressure transmitting medium is high, resistance, which is proportional to the moving velocity of the needle valve 4, is produced when the pressure transmitting medium passes through the small orifice 30. This results in a reduced colliding force of the stopper 4*a* of the needle valve 4 against the cylinder main body 41 at the time of opening and a reduced colliding force of the distal end of the needle valve 4 against the nozzle at the time of closing. The reduced colliding forces lead to a reduction in the repelling forces of the cylinder main body 41 and the nozzle applied to the needle valve 4.

According to the seventh embodiment thus construction, resistance, which is proportional to the moving velocity of the needle valve 4, is produced when the pressure transmitting medium passes through the small orifice 30. This reduces the colliding force of the stopper 4*a* of the needle valve 4 against the cylinder main body 41 at the time of opening and also the colliding force of the distal end of the needle valve 4 against the nozzle at the time of closing. The reduced colliding forces prevent parts from being damaged, resulting in a prolonged service life of the fuel injection system.

Furthermore, the reduced colliding force also leads to reduced repelling force. This solves the problem of the undesirable nonlinear relationship between a set valve opening period of time and an actual valve opening time of period. To be more precisely about the problem of the undesirable nonlinear relationship, when the valve opening period of time is set so that the closing operation is initiated immediately after the collision, the actual valve opening period of time is shorter than when the valve opening period of time is set so that the closing operation is initiated immediately before the collision because of the repulsion to the collision.

Moreover, the leakage of fuel G after the valve is closed, which is caused by the repulsion to the collision at the time of closing, is controlled, permitting highly accurate control of the injecting amount of fuel G.

In addition, since the temperature-dependent changes in the characteristics of the pressure transmitting medium, i.e., the changes in viscosity, is minimized, the colliding force can be reduced regardless of temperature changes. Thus, the advantages described above can be obtained over a wide range of temperature.

Figure 8A:
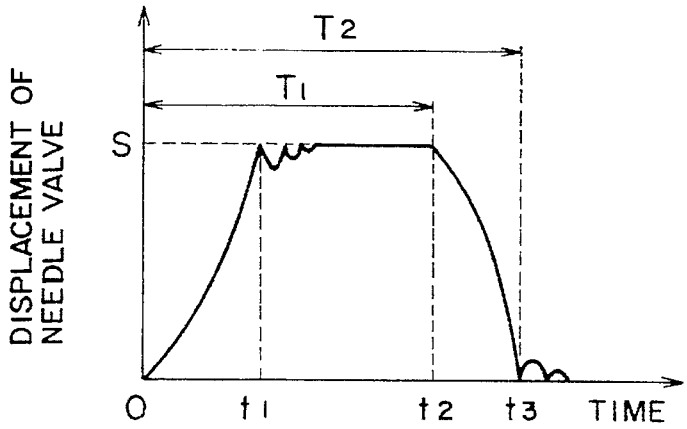
FIGS. 8A to 8C are operation charts illustrative of the opening and closing operation of a needle valve in a fuel injection system.
Figure 8B:
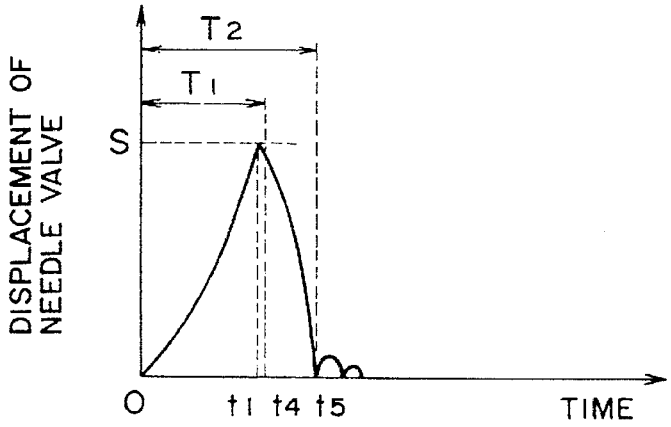
Figure 8C:
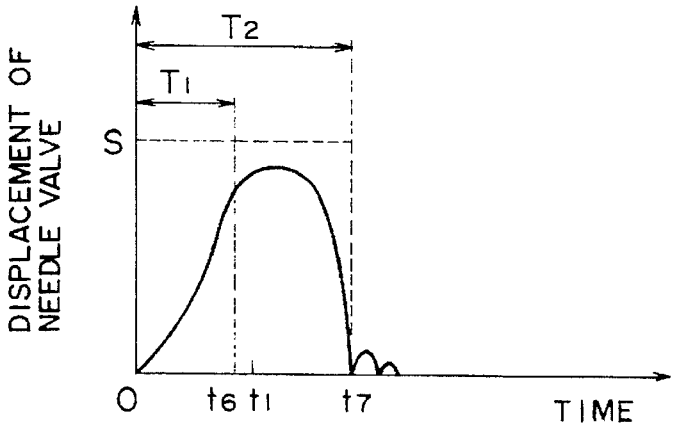

With reference to FIGS. 8A to 8C, detailed description will now be given to the undesirable nonlinear relationship between a set valve opening period of time and an actual valve opening period of time and the leakage of fuel G after closing the valve caused by the repulsion provoked by the collision taken place at the time of valve closing. FIGS. 8A to 8C show the displacement of the needle valve observed when the valve is opened and closed, the axis of ordinate representing the displacement of the needle valve 4 and the axis of abscissa representing time. Set valve opening period of time $T_1$ denotes the duration in which electric current is allowed to flow through the piezoelectric element 8 to open the injection aperture 1; actual valve opening period of time $T_2$ denotes the duration in which the injection aperture 1 actually stays open. Further, S denotes the position of the stopper 4*a*.

Referring to FIG. 8A, the case, wherein set valve opening period of time $T_1$ is sufficiently long, will be described.

Electric current is supplied to the piezoelectric element 8 until time $t_2$ to open the injection aperture 1. This causes the needle valve 4 to be displaced in the opening direction and the stopper 4*a* collides with the cylinder main body 41 in time $t_1$. At this time, the cylinder main body 41 applies a repelling force to the stopper 4*a* and the needle valve 4 is displaced in the closing direction. The needle valve 4 is, however, under the driving force for opening it; therefore, the needle valve 4 is displaced in the opening direction again. Then, the colliding force exerted by the stopper 4*a* on the cylinder main body 41 gradually weakens and the bounce of the needle valve 4 is attenuated until the stopper 4*a* comes in contact with the cylinder main body In time $t_2$, the supply of electric current to the piezoelectric element 8 is stopped. This causes the needle valve 4 to be displaced in the closing direction; in time $t_3$, the distal end of the needle valve 4 collides with the nozzle. At the time of this collision, the nozzle exerts a repelling force on the needle valve 4 to displace the needle valve 4 in the opening direction. The needle valve 4 is, however, under the driving force for opening it; therefore, the needle valve 4 is displaced in the closing direction again. Then, the colliding force exerted by the stopper 4*a* on the nozzle gradually weakens and the bounce of the needle valve 4 is attenuated until the distal end of the needle valve 4 closes the injection aperture 1.

Thus, fuel G is injected through the injection aperture 1 for actual valve opening period of time $T_2$ ($=t_s$).

Referring to FIG. 8B, the case, wherein set valve opening period of time $T_1$ is set so that closing is started immediately following the collision between the stopper 4*a* and the cylinder main body 41, will now be described.

Electric current is supplied to the piezoelectric element 8 until time $t_4$ to open the injection aperture 1. This causes the needle valve 4 to be displaced in the opening direction and the stopper 4*a* collides with the cylinder main body 41 in time $t_1$. At this time, the cylinder main body 41 applies a repelling force to the stopper 4*a* and the needle valve 4 is displaced in the closing direction. In time $t_4$, the supply of electric current to the piezoelectric element 8 is stopped. This causes the needle valve 4 to be displaced in the closing direction; in time $t_5$, the distal end of the needle valve 4 collides with the nozzle. At this time, the needle valve 4 has initial velocity in the closing direction due to the repelling force; therefore, the time required for closing is shorter than that shown in FIG. 8A. Hence, $t_3-t_2>t_5-t_4$.

Thus, fuel G is injected through the injection aperture 1 for actual valve opening period of time $T_2$ ($=t_5$).

It should be noted that, when the injection aperture 1 is closed, the needle valve 4 bounds as in the case shown in FIG. 8A.

Referring to FIG. 8C, the case, wherein set valve opening period of time $T_1$ is set so that closing is started immediately preceding the collision between the stopper 4*a* and the cylinder main body 41, will now be described.

Electric current is supplied to the piezoelectric element 8 until time $t_6$ to open the injection aperture 1. This causes the needle valve 4 to be displaced in the opening direction. In time $t_6$, the supply of electric current to the piezoelectric element 8 is stopped. This causes the needle valve 4 to be displaced in the closing direction; in time $t_7$, the distal end of the needle valve 4 collides with the nozzle. At this time, the needle valve 4 has initial velocity in the-opening direction due to inertia; therefore, the time required for closing is longer than that shown in FIG. 8A. Hence, $t_3-t_2>t_7-t_6$.

Thus, fuel G is injected through the injection aperture 1 for actual valve opening period of time $T_2$ ($=t_7$).

It should be noted that, when the injection aperture 1 is closed, the needle valve 4 bounds as in the case shown in FIG. 8A.

A fuel injection system controls the injecting amount of fuel G by controlling actual valve opening period of time $T_2$ by using set valve opening period of time $T_1$. Specifically, to increase the injecting amount of fuel G, set valve opening period of time $T_1$ is increased. As described above, however, actual valve opening period of time $T_2$, which is obtained when valve opening period of time $T_1$ is set so that the closing operation is begun immediately after the collision between the stopper 4a and the cylinder main body 41, undesirably becomes shorter than actual valve opening period of time $T_2$ which is obtained when set valve opening period of time $T_1$ is set so that the closing operation is begun immediately before the collision between the stopper 4a and the cylinder main body 41. In other words, set valve opening period of time $T_1$ and the actual valve opening period of time $T_2$ are inverted, presenting nonlinear relationship between the two.

Further, the repelling force generated by the collision of the distal end of the needle valve 4 against the nozzle causes the needle valve 4 to bound. Therefore, after the closing operation, the injection aperture 1 is opened due to the bounce of the needle valve 4, resulting in the leakage of fuel G.

According to the seventh embodiment, the colliding force of the stopper 4a of the needle valve 4 applied to the cylinder main body 41 at the time of opening decreases; therefore, the repelling force of the cylinder main body 41 applied to the stopper 4a at the time of the collision accordingly reduces. Thus, if valve opening period of time $T_1$ is set so that the closing operation is begun immediately after the collision between the stopper 4a and the cylinder main body 41, when the supply of electric current to the piezoelectric element 8 is cut off in $t_4$, a smaller repelling force in the closing direction is applied to the needle valve 4. As a result, the time required for completing the valve closing operation approaches that shown in FIG. 8A ($t_3-t_2 \approx t_5-t_4$). Thus, it is possible to avoid the inversion of set valve opening period of time $T_1$ and actual valve opening period of time $T_2$.

Further, the colliding force of the distal end of the needle valve 4 applied to the injection aperture 1 at the time of valve closing operation decreases, resulting in a reduced repelling force exerted by the injection aperture 1 on the needle valve 4. The reduced repelling force leads to less bounce of the needle valve 4 which takes place when the injection aperture 1 is closed, thus making it possible to control the occurrence of the leakage of fuel G after the valve closing operation is completed.

[Eighth Embodiment]

Figure 9:
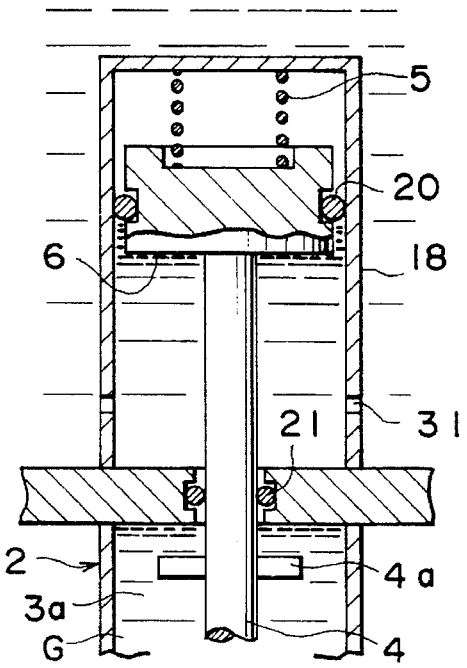
FIG. 9 is a longitudinal sectional view illustrative of a cylinder assembly of a fuel injection system according to an eighth embodiment of the present invention.

FIG. 9 is the longitudinal sectional view illustrative of the cylinder assembly of a fuel injection system according to the eighth embodiment of the present invention.

In the eighth embodiment, an opening 31 is provided in the side wall of the cylinder 18. The cross-sectional area of the opening 31 is smaller than that of the inflow/outflow hole 22, therefore, the opening 31 serves as an orifice. The rest of the construction is the same as the construction of the first embodiment described above.

In the eighth embodiment, when the piston 9 is driven by the piezoelectric element 8, the pressure transmitting medium flows into the cylinder 18 from the pressure control chamber 10 through the opening 31, or it flows into the pressure control chamber 10 from the cylinder 18 through the opening 31. At this time, since the opening 31 has a small cross-sectional area, the opening 31 functions as an orifice, restricting the flow rate of the pressure transmitting medium going through the opening 31. This causes a delay in the rise or fall of the fluid pressure in the cylinder 18 in relation to the rise or fall of the fluid pressure in the pressure control chamber 10, thus restraining the moving velocity of the needle valve 4.

Therefore, the eighth embodiment provides the same advantages as those of the seventh embodiment described above.

[Ninth Embodiment]

Figure 10:
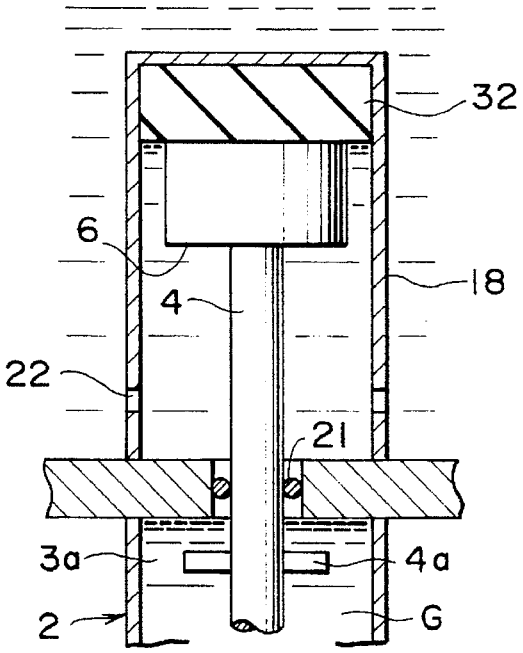
FIG. 10 is a longitudinal sectional view illustrative of a cylinder assembly of a fuel injection system according to a ninth embodiment of the present invention.

FIG. 10 is the longitudinal sectional view illustrative of the cylinder assembly of a fuel injection system according to the ninth embodiment of the present invention.

In the ninth embodiment, in place of the compression spring 5, a low-resilience rubber 32 is disposed between the cylinder 18 and the other end surface of the needle valve 4. The low-resilience rubber 32 is preferably made of silicone rubber or other material which exhibits good attenuation characteristic, that is, high resistance to deforming velocity, and which has an impact resilience of 50 or less. The rest of the construction is the same as the construction of the first embodiment discussed above.

According to the ninth embodiment, the low-resilience rubber 32 applies pre-load to the needle valve 4. When the fluid pressure applied to the opening pressure receiving section 6 of the needle valve 4 goes up, the needle valve 4 moves in the direction for opening the injection aperture 1 and the low-resilience rubber 32 contracts. At this time, the low-resilience rubber 32 develops high resistance, restraining the moving velocity of the needle valve 4. Thus, the ninth embodiment also provides the same advantages as those of the seventh embodiment described above.

In the ninth embodiment, if the low-resilience rubber 32 is disposed in contact with the other end surface of the needle valve 4, then there is no need to provide the pressure receiving seal 20.

[Tenth Embodiment]

Figure 11:
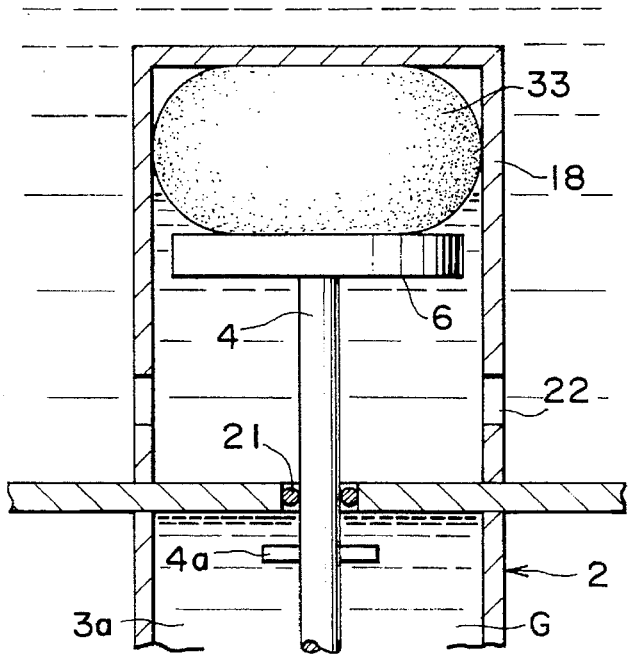
FIG. 11 is a longitudinal sectional view illustrative of a cylinder assembly of a fuel injection system according to a tenth embodiment of the present invention.

In the ninth embodiment above, the low-resilience rubber 32 is employed as the pre-loading means. In the tenth embodiment, as shown in FIG. 11, a balloon-like rubber 33, which has air or oil sealed in to allow high deformation, is employed for the pre-loading means to provide the same advantages. While in the ninth embodiment, the spring constant is determined by the disposing space and the material of the low-resilience rubber 32, in the tenth embodiment, the spring constant can be adjusted by adjusting the pressure of the air or oil to be sealed in. Hence, the tenth embodiment adds another advantage in that a higher degree of freedom of the spring constant with respect to the shape is obtained.

[Eleventh Embodiment]

Figure 12:
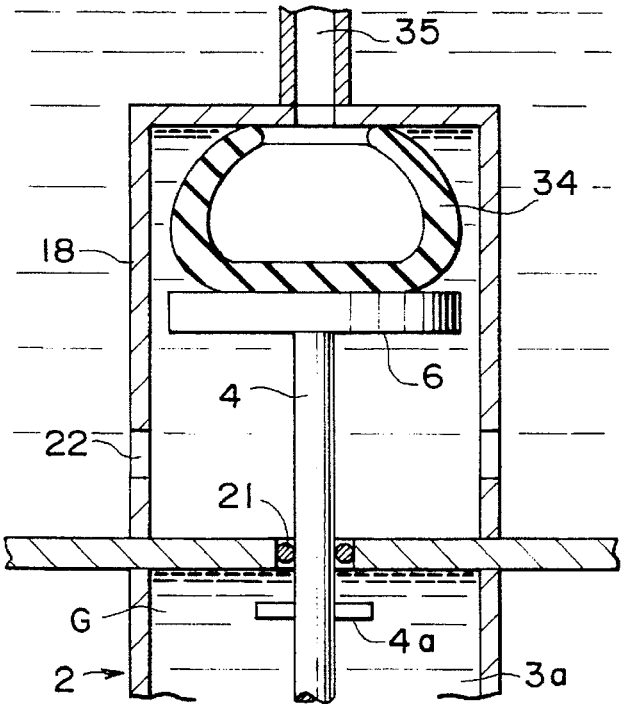
FIG. 12 is a longitudinal sectional view illustrative of a cylinder assembly of a fuel injection system according to an eleventh embodiment of the present invention.

Instead of the low-resilience rubber 32 used as the pre-loading means in the ninth embodiment, a buffer 34 is employed as the pre-loading means for the eleventh embodiment as illustrated in FIG. 12. The buffer 34 is made of silicone rubber, for example, and it has a predetermined spring constant. Further, the buffer 34 is designed so that it develops a predetermined attenuation characteristic by the resistance produced when air passes through an opened-to-the-air aperture 35 which is formed in the cylinder 18. Accordingly, the buffer 34 restrains the moving velocity of the needle valve 4, enabling the eleventh embodiment to provide the same advantages as those of the seventh embodiment discussed above. The attenuation characteristic is controlled by the cross-sectional area of the opened-to-the-air aperture 35.

[Twelfth Embodiment]

In the twelfth embodiment, a voltage controlling means is used to reduce a time-dependent change in the driving voltage applied to the piezoelectric element 8 immediately before the completion of the lift of the needle valve 4.

Figure 13A:
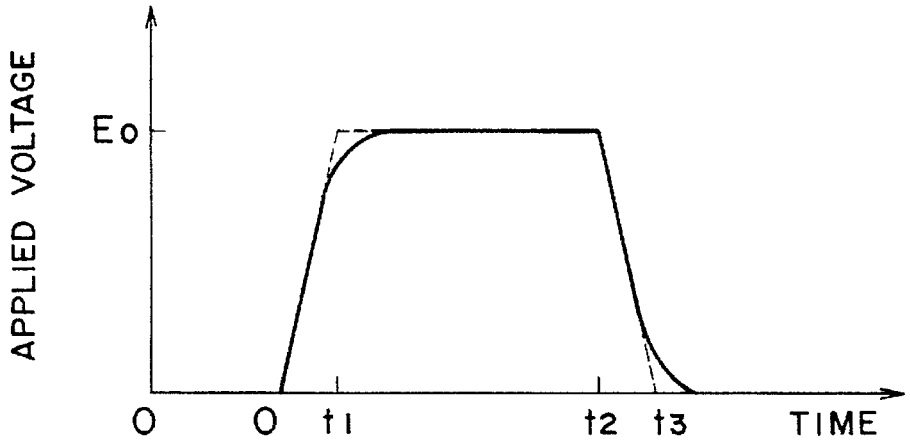
FIGS. 13A and 13B illustrate the operation of a piezoelectric element in a fuel injection system according to a twelfth embodiment of the present invention.
Figure 13B:
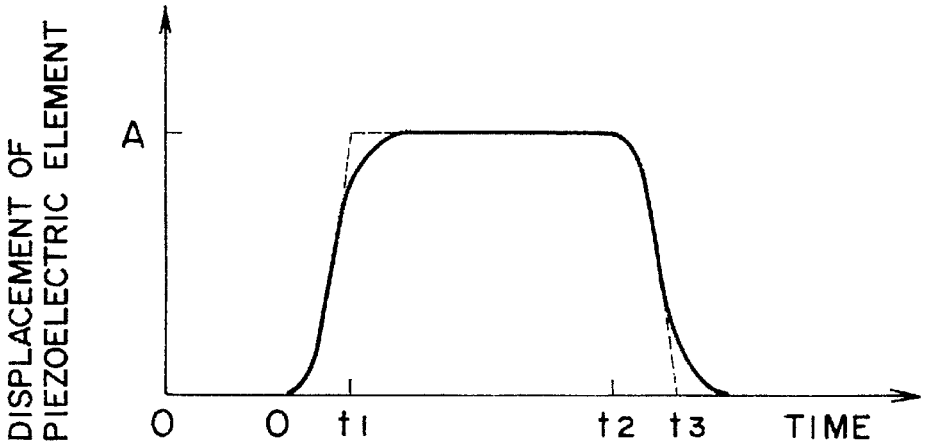

Conventionally, the waveform of the driving voltage applied to the piezoelectric element 8 at the time of valve opening indicates that the driving voltage is increased from 0 volt to $E_0$ volts (until time $t_1$) at a constant step-up rate then the voltage of $E_0$ volts is maintained as shown by the dashed line of FIG. 13A. The waveform of the driving voltage at the time of valve closing indicates that the voltage is decreased from the voltage of $E_0$ volts (from time $t_2$) to 0 volt at a constant step-down rate. When the driving voltage applied to the piezoelectric element 8 is controlled in this manner, the piezoelectric element 8 expands in proportion to the driving voltage as indicated by the dashed line of FIG. 13B; it expands by displacement A, which corresponds to the driving voltage of $E_0$ volts, in time $t_1$; it contracts in proportion to the driving voltage from time $t_2$, then it restores the original dimensions thereof in time $t_3$.

In the twelfth embodiment, the voltage controlling means is provided with, e.g. a time function so that the gradient of the driving voltage is dulled immediately before the completion of the valve opening and closing operation, thereby the step-up rate of the driving voltage applied to the piezoelectric element 8 is decreased immediately before the completion of the valve opening operation and the step-down rate is also decreased immediately before the completion of the valve closing operation as shown by the waveform indicated by the solid line of FIG. 13A. This means that the time-dependent change, i.e. the gradient, of the driving voltage is dulled immediately before the completion of the lift of the needle valve 4 as it is shown by the waveform of the driving voltage. Thus, the displacement ratio of the piezoelectric element 8 decreases immediately before the completion of the lift of the needle valve 4 as indicated by the solid line in FIG. 13B. Accordingly, the change in the fluid pressure of the pressure transmitting medium decreases immediately before the completion of the lift of the needle valve 4 and the moving velocity of the needle valve 4 decreases immediately before the completion of the lift. This results in a reduced colliding force exerted by the stopper 4*a* of the needle valve 4 on the cylinder main body 41 at the time of valve opening and also a reduced colliding force exerted by the distal end of the needle valve 4 on the nozzle at the time of valve closing.

According to the twelfth embodiment, the colliding force exerted by the stopper 4*a* of the needle valve 4 on the cylinder main body 41 at the time of valve opening and the colliding force exerted by the distal end of the needle valve 4 on the nozzle at the time of valve closing can be reduced by dulling the driving voltage applied to the piezoelectric element 8 immediately before the completion of the lift of the needle valve 4 through the controlling means. This makes it possible to obtain the same advantages as those of the seventh embodiment discussed above without adopting any special structure.

[Thirteenth Embodiment]

Figure 14:
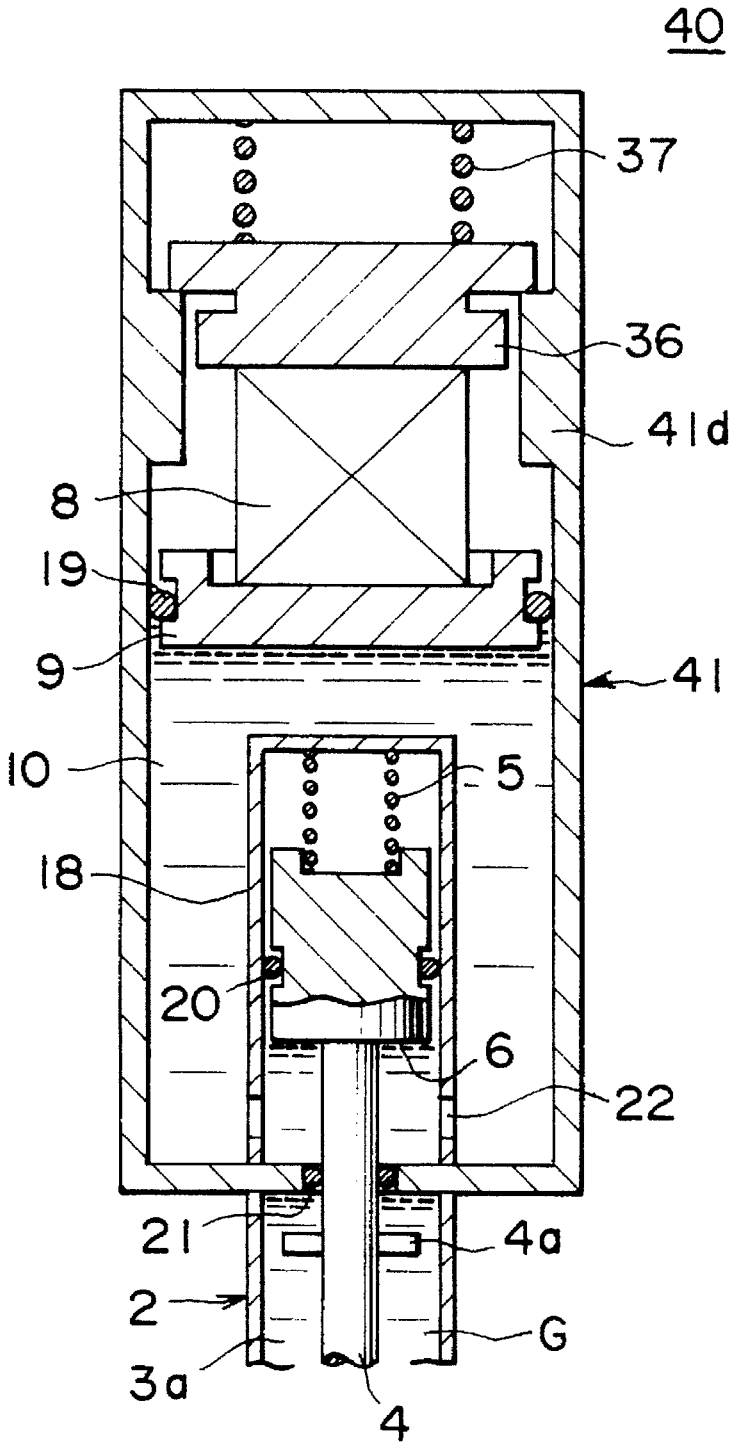
FIG. 14 is a longitudinal sectional view illustrative of a cylinder main body assembly of a fuel injection system according to a thirteenth embodiment of the present invention.

FIG. 14 is the longitudinal sectional view illustrative of the cylinder main body assembly of a fuel injection system according to the thirteenth embodiment of the present invention.

In the figure, a holding plate 36 is provided on the top of the piezoelectric element 8. A spring 37 is provided in a compressed state between the holding plate 36 and the top inner surface of the cylinder main body 41. Provided on the inner surface of the side wall of the cylinder main body 41 is the stopper 41*d* which engages with the outer periphery of the holding plate 36 to prevent the holding plate 36 from moving downward. The holding plate 36, the spring 37, and the stopper 41*d* constitute a pressure relaxing means. The rest of the construction is the same as the construction of the first embodiment already described.

The operation of the thirteenth embodiment will now be described.

The holding plate 36 is pushed downward by the urging force of the spring 37; the outer periphery of the holding plate 36 engages with the stopper 41*d* to prevent the holding plate 36 from moving downward. Downward load Fk is applied to the holding plate 36 by the spring 37, load Fk being received by the stopper 41*d* via the holding plate 36.

When the piezoelectric element 8 is expanded to open the injection aperture 1, upward driving force is applied to the holding plate 36. Downward load Fk applied to the holding plate 36 is, however, set to be larger than the driving force generated by the piezoelectric element 8; therefore, the upward movement of the holding plate 36 is prevented. As a result, the driving force generated by the piezoelectric element 8 is applied to the piston 9 and the valve opening operation by the needle valve 4 is implemented.

In this case, if, for some reason, an excess rise takes place in the fluid pressure of the pressure transmitting medium in the pressure control chamber 10, then the increased fluid pressure pushes up the piston 9. This force applied to the piston 9 is transmitted to the holding plate 36 via the piezoelectric element 8. When the force applied to the piston 9 overcomes load Fk, the spring 37 contracts, moving the holding plate 36 upward. This in turn causes the capacity of the pressure control chamber 10 to increase, easing the rise in the fluid pressure of the pressure transmitting medium.

According to the thirteenth embodiment thus constructed, an excessive rise in the fluid pressure of the pressure transmitting medium in the pressure control chamber 10 can be prevented. The piezoelectric element 8 is not subjected to load which exceeds Fk. Therefore, it is possible to protect the piezoelectric element 8 from damage by setting proper load Fk applied by the spring 37 according to the pressure resistance of the piezoelectric element 8.

[Fourteenth Embodiment]

Figure 15:
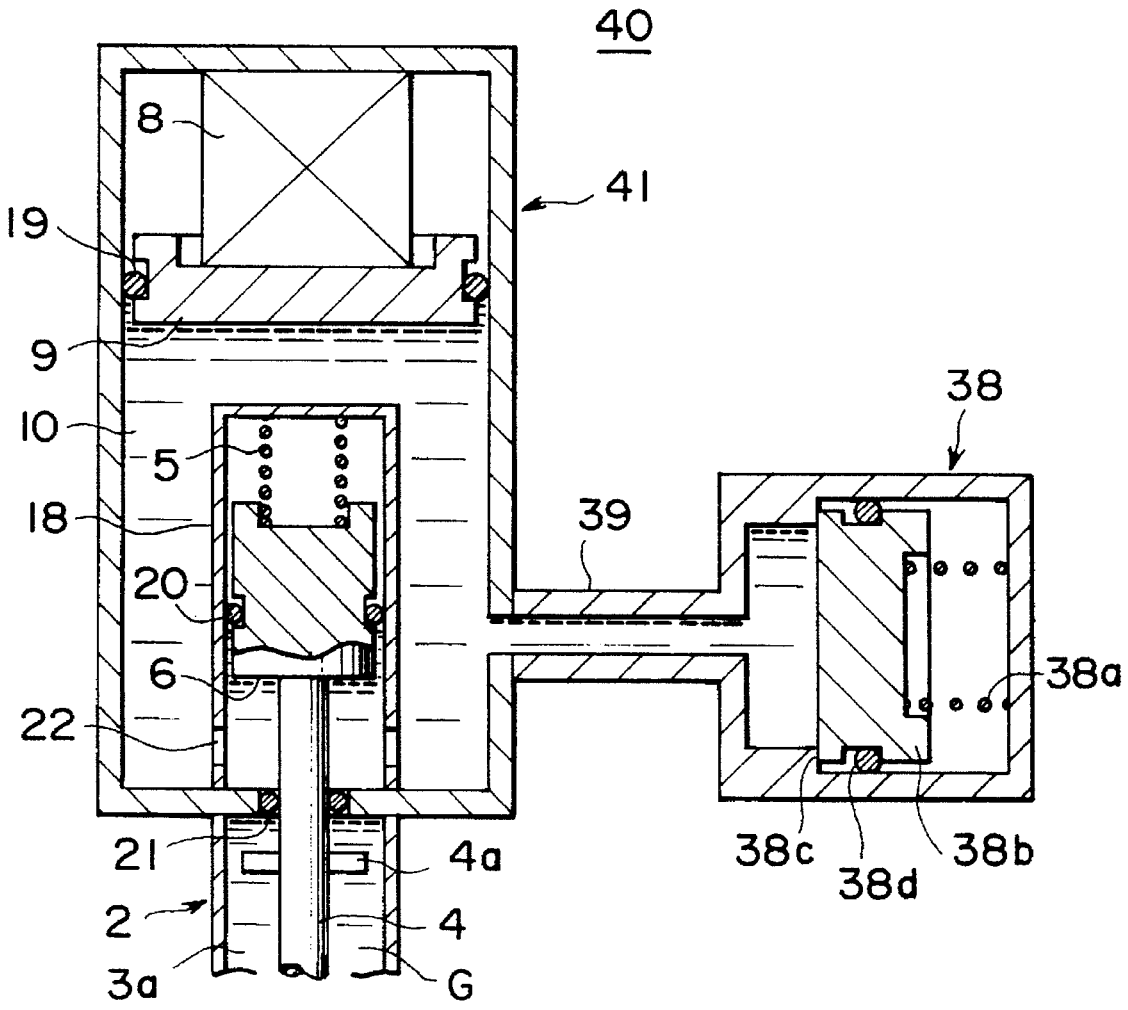
FIG. 15 is a longitudinal sectional view illustrative of a cylinder main body assembly of a fuel injection system according to a fourteenth embodiment of the present invention.

FIG. 15 is the longitudinal sectional view illustrative of the cylinder main body assembly of a fuel injection system according to the fourteenth embodiment of the present invention.

In the figure, a cylinder chamber 38, which functions as the pressure relaxing means, is provided so that it is communicated with the pressure control chamber 10 of the cylinder main body 41 via a liquid channel 39. Provided in the cylinder chamber 38 are a spring 38*a*, which has been set to load Fk, and a piston 38*b*. A stopper 38*c* provided on the inner wall surface of the cylinder chamber 38 prevents the piston 38*b* from moving in one direction. Further, a piston seal 38*d* is provided around the outer periphery of the piston 38*b* to prevent the pressure transmitting medium from flowing to the spring 38*a* side. The rest of the construction is the same as the construction of the first embodiment described above.

In the fourteenth embodiment, the urging force of the spring 38*a* pushes the piston 38*b* toward the stopper 38*c*. Further, the outer periphery of the piston 38*b* engages with the stopper 38*c*, so that the piston 38*b* is not allowed to move toward the stopper 38*c*. The piston 38*b* is subjected to load Fk in the direction of the stopper 38*c* by the spring 38*a*, load Fk being received by the stopper 38*c* via the piston 38*b*.

If, for some reason, an excessive rise takes place in the fluid pressure of the pressure transmitting medium in the pressure control chamber 10, then the increased fluid pressure is applied to the piston 38*b* through the liquid channel 39. When the force applied to the piston 38*b* surpasses load Fk, the spring 38*a* contracts, causing the piston 38*b* to move toward the spring 38*a*. This increases the capacity of the pressure control chamber 10, easing the rise in the fluid pressure of the pressure transmitting medium.

Thus, according to the fourteenth embodiment, the same advantages as those of the thirteenth embodiment described above are obtained.

What is claimed is:

1. A fuel injection system comprising:

a valve main body having a needle guide cavity with the distal end thereof formed as an injection aperture, fuel passing through said needle guide cavity to be injected through said injection aperture;

a pressure control chamber filled with a pressure transmitting medium;

a piston for changing the fluid pressure of said pressure transmitting medium in said pressure control chamber;

a needle valve having one end thereof located in said needle guide cavity and the other end thereof located in said pressure control chamber, said needle valve being installed in such a manner that it is allowed to move to open or close said injection aperture;

a pressure receiving section which is provided on a portion of said needle valve located in said pressure control chamber and which is subjected to said fluid pressure;

a pre-loading means for pre-loading said needle valve in a direction for closing said injection aperture; and a piezoelectric element which changes said fluid pressure of said pressure transmitting medium by driving said piston, applies said changed fluid pressure to said pressure receiving section, and moves said needle valve in a direction for opening or closing said injection aperture so as to start or stop the flow of an injection fuel through said injection aperture, wherein a flow channel for said injection fuel is airtightly independent from said pressure control chamber, and wherein said pressure transmitting medium is completely sealed off from said injection fuel by a sealing member.

2. A fuel injection system according to claim 1, wherein a housing chamber for containing the other end of said needle valve is disposed inside said pressure control chamber, a small hole is provided on said housing chamber for communicating between said pressure receiving section side of said needle valve and said pressure control chamber, and said pressure transmitting medium filled in said pressure control chamber and said housing chamber is a liquid which has a higher viscosity coefficient than that of the fuel and which exhibits a small temperature-dependent change in the characteristic thereof.

3. A fuel injection system according to claim 1, wherein an orifice is provided in a pressure transmitting passage between said piston and said pressure receiving section in said pressure control chamber.

4. A fuel injection system according to claim 1, wherein said pre-loading means is made of a material which has an excellent attenuation characteristic.

5. A fuel injection system according to claim 1, further comprising a voltage controlling means which controls a driving voltage applied to said piezoelectric element so that a time-dependent change in said driving voltage is reduced immediately before the lift of the needle valve is completed.

6. A fuel injection system according to claim 1, further comprising a control relaxing means for relaxing said fluid pressure of said pressure transmitting medium in said pressure control chamber, whereby an excessive increase in said fluid pressure of said pressure transmitting medium is prevented.

7. A fuel injection system according to claim 1, wherein said pre-loading means is disposed in a gaseous chamber.

* * * * *